US006318038B1

(12) United States Patent
Park

(10) Patent No.: US 6,318,038 B1
(45) Date of Patent: Nov. 20, 2001

(54) APPARATUS FOR RETENSING PRE-STRESS STRUCTURE

(76) Inventor: Jae Man Park, 155-1, Neungwon-Ri, Mohyun-Myun, Yongin, Kyungki-Do (KR)

( * ) Notice: Subject to any disclaimer, the term of this patent is extended or adjusted under 35 U.S.C. 154(b) by 0 days.

(21) Appl. No.: 09/224,712

(22) Filed: Dec. 31, 1998

(30) Foreign Application Priority Data

Dec. 31, 1997 (KR) ..... 97/82358
Jun. 9, 1998 (KR) ..... 98/9747

(51) Int. Cl.[7] ..... E04C 5/08

(52) U.S. Cl. ..... 52/223.13; 52/223.14; 29/452; 264/40.1

(58) Field of Search ..... 52/223.13, 223.14, 52/223.8, 223.11, 223.1, 223.12; 264/228, 229, 40.1; 29/446, 452, 897.1

(56) References Cited

U.S. PATENT DOCUMENTS 4,593,905 * 6/1986 Abel ..... 473/534
4,805,877 * 2/1989 Hoekstra ..... 29/452

FOREIGN PATENT DOCUMENTS 96-4668 7/1994 (KR) .

* cited by examiner

*Primary Examiner*—Michael Safavi
(74) *Attorney, Agent, or Firm*—Birch, Stewart, Kolasch & Birch, LLP

(57) ABSTRACT

An apparatus for retensing a pre-stress structure. The apparatus includes a tensing apparatus installed at a rear portion of a precast strand support fixing member exposed from both ends of a prestress structure such as a precast beam for repeatedly tensing a precast strand having a stress loss. A checking member provided at the retensing apparatus for visually checking a stress loss in the tensed precast strand for thereby implementing an easier tensing of a reinforcing strand which is needed when fabricating a prestress structure and retensing an internal reinforcing strand even when a prestress loss occurs for thereby repeatedly retensing a deformed prestress structure.

8 Claims, 8 Drawing Sheets

APPARATUS FOR RETENSING PRE-STRESS STRUCTURE

BACKGROUND OF THE INVENTION

1. Field of the Invention

The present invention relates to an apparatus for retensing a pre-stressed structure, and in particular to an apparatus for retensing a pre-stressed structure which is capable of recovering a deformed prestressed structure to its original state by retensing tensing members disposed in the interior of a prestressed structure having a predetermined stress loss.

2. Description of the Conventional Art

A prestress force in a prestressed structure such as a prestressed concrete beam, etc. is gradually decreased by a predetermined loss factor such as a creep of a concrete, a dehydration-based contraction, a relaxation of a prestressed concrete member, etc.

In the case that the loss of a stress is gradually increased in a structure such as a bridge beam, the bridge may be slacked. The slacking of the bridge beam may cause a critical damage to the beam as well as the bridge structure. In this case, a proper maintenance or repair is urgently needed for preventing a further accident such as a collapse of the bridge.

In the conventional prestressed structure such as a prestressed concrete beam, a plurality of strand cones are installed at both ends of a beam structure in which both ends of the strand are exposed when manufacturing the prestressed concrete beam, and the tensing of the strand is implemented using a tension apparatus. Thereafter, the tension apparatus is removed, and a cement mortar is injected into a sheath tube having a strand therein.

FIGS. 9 and 10 illustrate a bridge structure in which a conventional prestressed concrete beam is installed. In a bridge prestressed concrete beam 1, longitudinal ends of each beam are installed on the upper portion of a supporting apparatus 3 installed on the upper portions of the piers 2. An upper plate 4 is mounted on the upper surface of each prestressed concrete beam 1.

In the thusly constituted conventional prestressed concrete beam 1, a cement mortar is filled at the end portion of each sheath tube 6 into which a strand formed of a plurality of wire strands is inserted, and a plurality of fixing members 7 are exposed into concave space portions 1*a* formed at the end portions of the beam 1. In the above-described structure, it is impossible to retense each strand fixed to the fixing member 7 through the space portion 1*a* formed between the end portions of each beam structure. In addition, since a cement mortar is filled into the space portion 1*a* through which each fixing member 7 is exposed, it is impossible to correct the deformation of the beam structure due to the retensing of the inner strand disposed in the interior of the beam structure when a slack occurs at the beam 1.

Therefore, as a technique for repairing the bridge beam in which a slack occurs, the following technique is well known.

A plurality of through holes are horizontally formed through the beam structure in the direction of its width at both ends of the prestressed concrete beam in which the slacking occurs, and a reinforcing steel member is inserted and buried into each through hole. Thereafter, another external reinforcing steel member is installed in the vertical direction at the ends of each buried steel member extended from both walls of the beam structure, and then a cement concrete is formed at the engaged portions of the external reinforcing steel member for thereby forming a concrete support portion extended from both external sides of the beam structure.

Next, a fixing member supporting the end portions of the strands is installed at an end portion of the concrete support member, and the end portion of each strand is fixed at the fixing member along both side lateral walls of the beam structure, and the end portions of each strand formed of a plurality of wire strands are tensed using a tension apparatus, and the deformed portion of the beam structure is recovered by lifting up the deformed portion of the same for thereby correcting the slacking of the bridge beam and the upper plate, so that the strength of the beam structure is enhanced.

However, in this conventional bridge beam maintenance technique, when installing a plurality of reinforcing strands along both side lateral surfaces of the beam structure, and installing the support member such as a protrusion support member, an external fixing member, etc., the construction period is long, and the fabrication process is complicated. In addition, since a plurality of through holes are formed in the beam structure, the strength of the beam is decreased, so that it is impossible to implement a stable bridge structure.

In addition, in the conventional fixing member in which a plurality of wire strands are supported, if a relaxation or a predetermined damage occurs in the steel member, it is impossible to individually retense the deformed member or to exchange the deformed member with a new one. If one strand is cut, the entire strands may be cut for thereby causing a large accident.

In order to overcome the above-described problems encountered in the conventional bridge maintaining and reinforcing technique, the inventor of this invention discloses a patent application entitled "Method and apparatus for maintaining a bridge beam" in 1994 having its Korean Patent Laid-open publication No. 1996-4668. In this application, both end support brackets in which a plurality of fixing members are installed are fixed at both ends of the prestressed concrete beam for correcting a deformation. Both ends of each strand supported by the lateral surface support bracket installed at an intermediate portion of the beam structure are tensed and fixed by each collet provided at the support member of the fixing member, for thereby effectively maintaining the prestressed concrete beam of an aged bridge.

According to the above-described method and apparatus for maintaining a bridge beam, it is possible to prevent the decrease of the strength of the beam structure which may be caused due to a plurality of through holes formed at both end portions of the prestressed concrete beam. In addition, the strength of the support portion of the fixing member supporting both ends of each reinforcing strand is significantly increased. In addition, the maintaining period may be decreased compared to the conventional technique. Since it is possible to individually repair a deformed or slacked strand supported by the external fixing member and newly add a predetermined number of strands thereto, even when a large stress occurs in the strand, the entire strands are not affected for thereby implementing an easier maintenance and exchange of the deformed or slacked beam.

However, in the bridge beam maintaining method based on the conventional maintaining method and above-described Korean patent application, the construction is relatively expensive, and it is difficult to check whether or not the retensing is needed for the structure when the tensed strand is relaxed, namely, to perform the stability test when a predetermined stress loss occurs in the strand. In more detail, when adapting the prestress structure to the bridge beam, in order to check whether or not the retensing is needed for the strand when the beam is deformed, a predetermined measuring method such as a vehicle loading test is performed. In this case, the loading test is irregularly performed for thereby retensing the deformed structure. If the above-described loading test is missed, the strength of the beam structure may be significantly decreased, so that the recovering of the beam structure may not be implemented by the repair or maintenance. As a result, in order to prevent the breakage or collapse of the bridge, the entire bridge structure may be rebuilt.

In this case, the bridge may not be used for a predetermined period for the vehicle loading test resulting in a large traffic jam in other areas.

SUMMARY OF THE INVENTION

Accordingly, it is an object of the present invention to provide an apparatus for retensing a pre-stressed structure which overcomes the problems encountered in a conventional art.

It is another object of the present invention to provide an apparatus for retensing a pre-stressed structure which is capable of implementing an easier tensing of a strand which is needed when manufacturing a prestressed structure and retensing an internal strand even when a prestress loss occurs in a state that a prestressed structure is used for a bridge beam for thereby repeatedly retensing a deformed prestress structure.

It is another object of the present invention to provide an apparatus for retensing a prestressed structure which is capable of retensing a deformed prestressed structure by checking a deformation due to a stress loss of a strand of a prestressed structure installed for a bridge beam, etc. and overcoming the problems encountered in the conventional art in which the bridge may not be used for a predetermined period when performing the vehicle loading test.

It is another object of the present invention to provide an apparatus for retensing a prestressed structure which is capable of minimizing an operation range of a tension jack for implementing an easier work at a limited narrow space when controlling the tension force of a prestressed structure such as a prestressed concrete beam in which a stress loss such as a deformation, and a slack occurs.

To achieve the above objects, there is provided an apparatus for retensing a prestressed structure which includes a tensing apparatus installed at a rear portion of a strand support fixing member exposed from both ends of a prestressed stucture such as a prestressed concrete beam for repeatedly tensing a strand having a stress loss, and a checking member provided at the retensing apparatus for visually checking a stress loss in the tensed strand.

The retensing apparatus includes a tension member disposed at an end portion of the fixing member supported by both ends of the strand for tensing the strand extended toward to the rear portion of the fixing member, a distance maintaining member disposed between the tension member and the fixing member for preventing each collet escaped from each strand tensed in accordance with an operation of the tension jack and the support member from being moved by a predetermined distance, and a fixing member installed at a rear end of the tension jack for fixing the ends of each strand tensed by the tension jack.

The retensing apparatus includes a pressure meter disposed at the tension apparatus such as the tension jack for indicating the force used for tensing the strand as a pressure applied to a fluid pressure chamber of a tension jack, namely, the load carrying capacity of the tension jack.

When a loss occurs in the tension stress of the first tensed strand, it means that the load carrying capacity of the tension jack is decreased. The decrease in the load carrying capacity of the tension jack means the decrease of the pressure values of the pressure meter. Therefore, it is possible to visually check the stress loss of the strand. In the case of the stress loss, the strand is easily retensed using the tension apparatus.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 6A through 6D are views illustrating an operation of a retensing apparatus according to the present invention, of which:

FIG. 6A is a vertical cross-sectional view before a strand is tensed by operating a tension jack of a retensing apparatus;

FIG. 6B is a vertical cross-sectional view illustrating a state that a strand is tensed in accordance with an operation of a tension jack;

FIG. 6C is a vertical cross-sectional view illustrating a state that a retensing of a strand is needed as the decrease in the load-carrying capacity of a tension jack is checked by a pressure meter when a tension stress of a strand is decreased in a state that a tension jack is recovered;

FIG. 6D is a view illustrating a process that a tension jack is recovered from the state of FIG. 6B to the state that the tension jack is tensed;

DETAILED DESCRIPTION OF THE PREFERRED EMBODIMENTS

Figure 1:
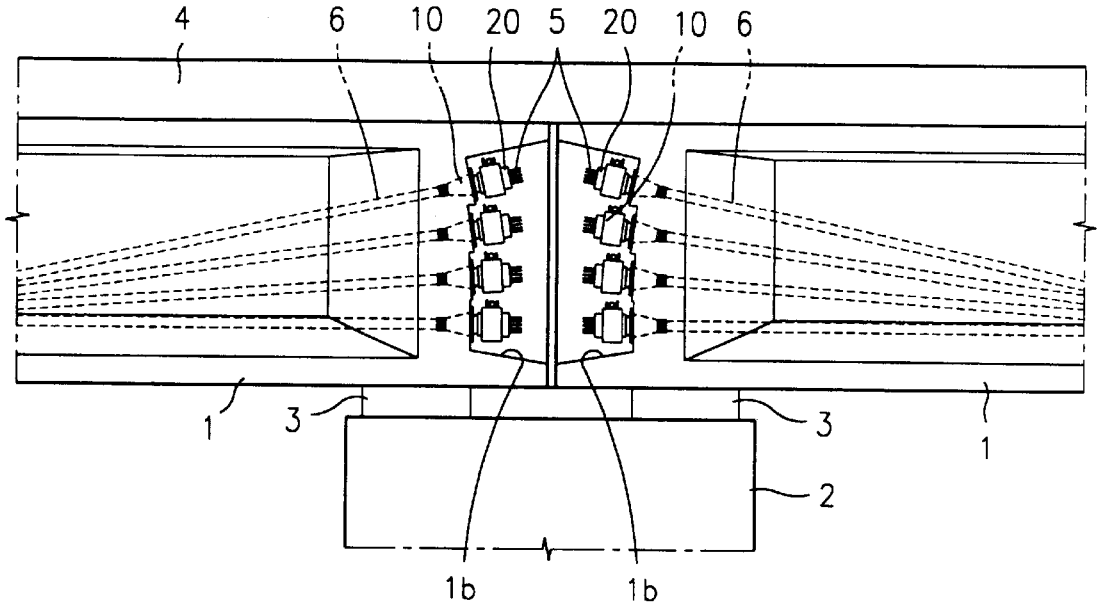
FIG. 1 is a partial side view illustrating a bridge structure for explaining an installation state of a retensing apparatus according to the present invention.
Figure 2:
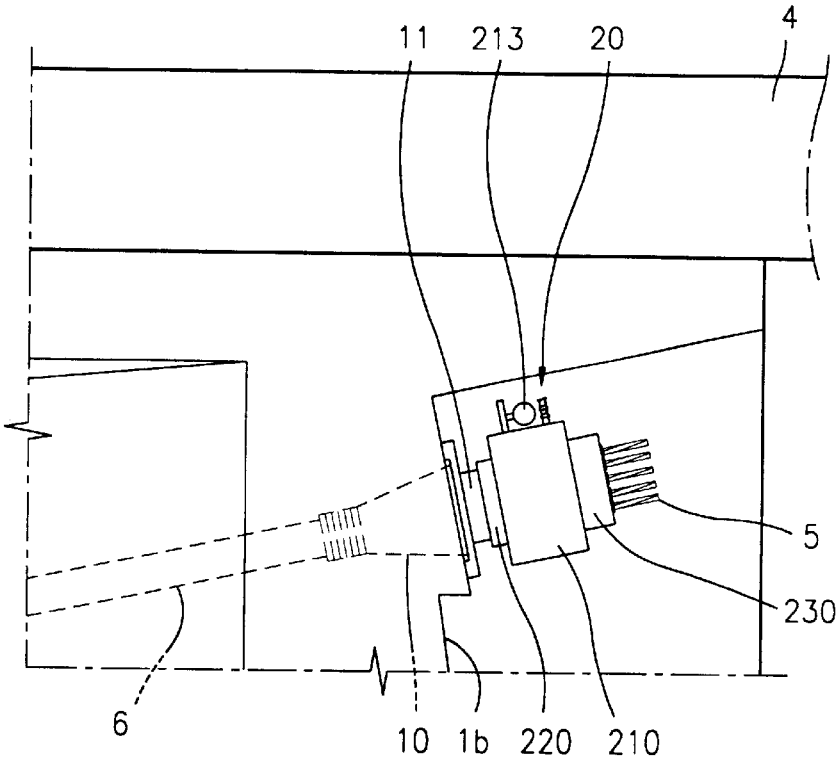
FIG. 2 is a partially enlarged view illustrating an installation portion of the retensing apparatus of FIG. 1.
Figure 3:
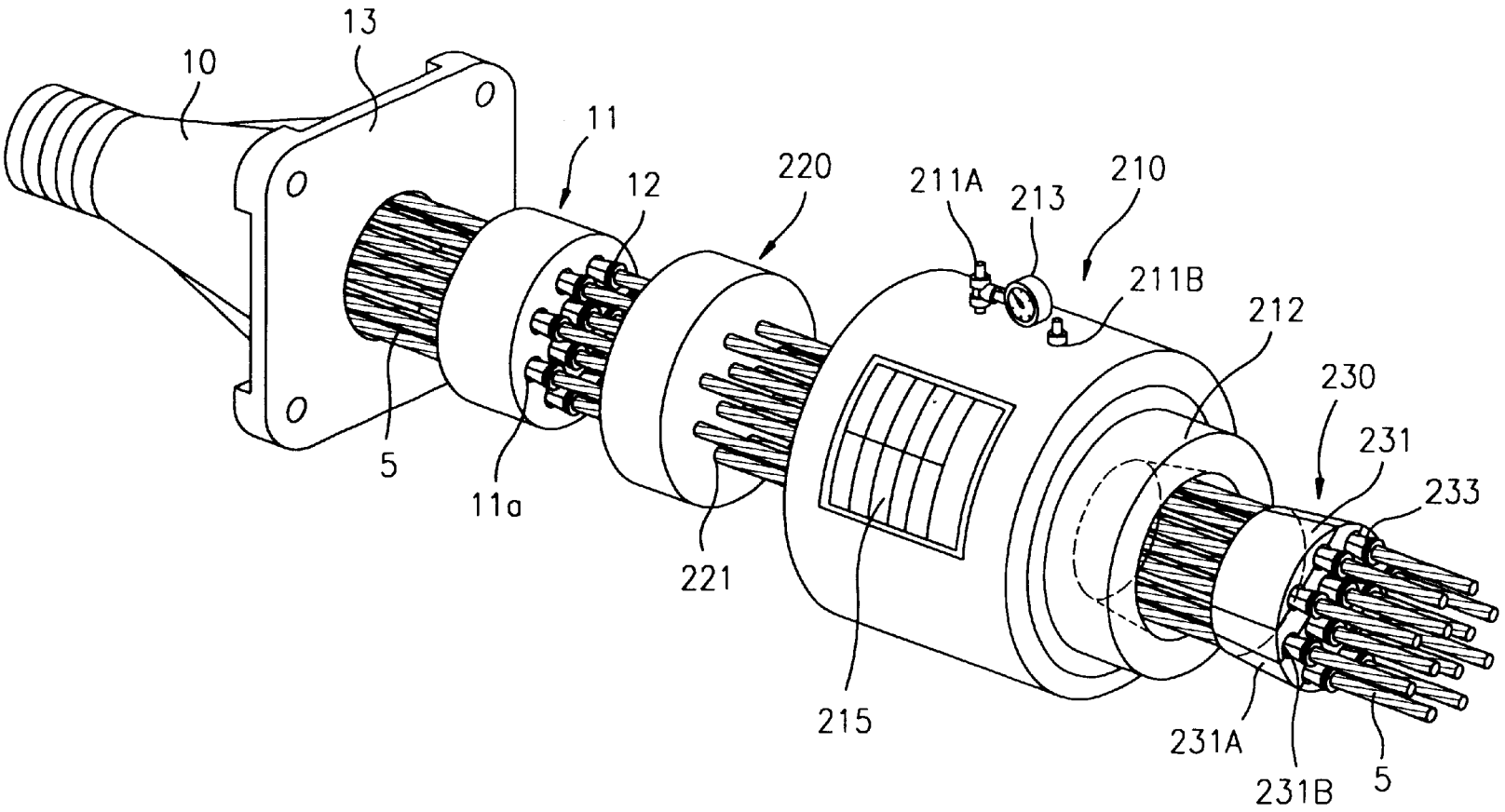
FIG. 3 is an exploded perspective view illustrating the construction of a retensing apparatus according to the present invention.
Figure 4:
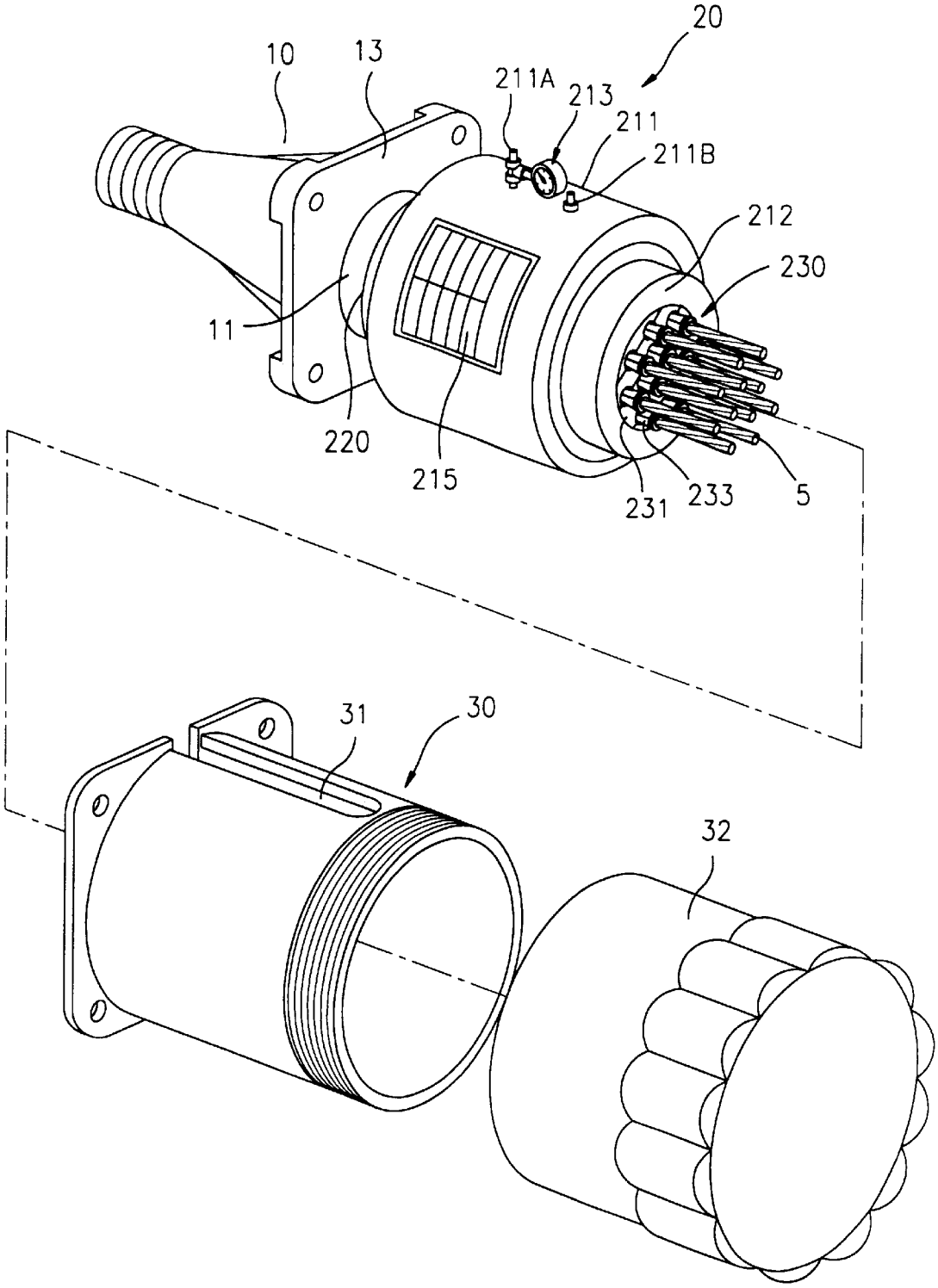
FIG. 4 is a perspective view illustrating an engaged state of a retensing apparatus and a protection cap according to the present invention.
Figure 5:
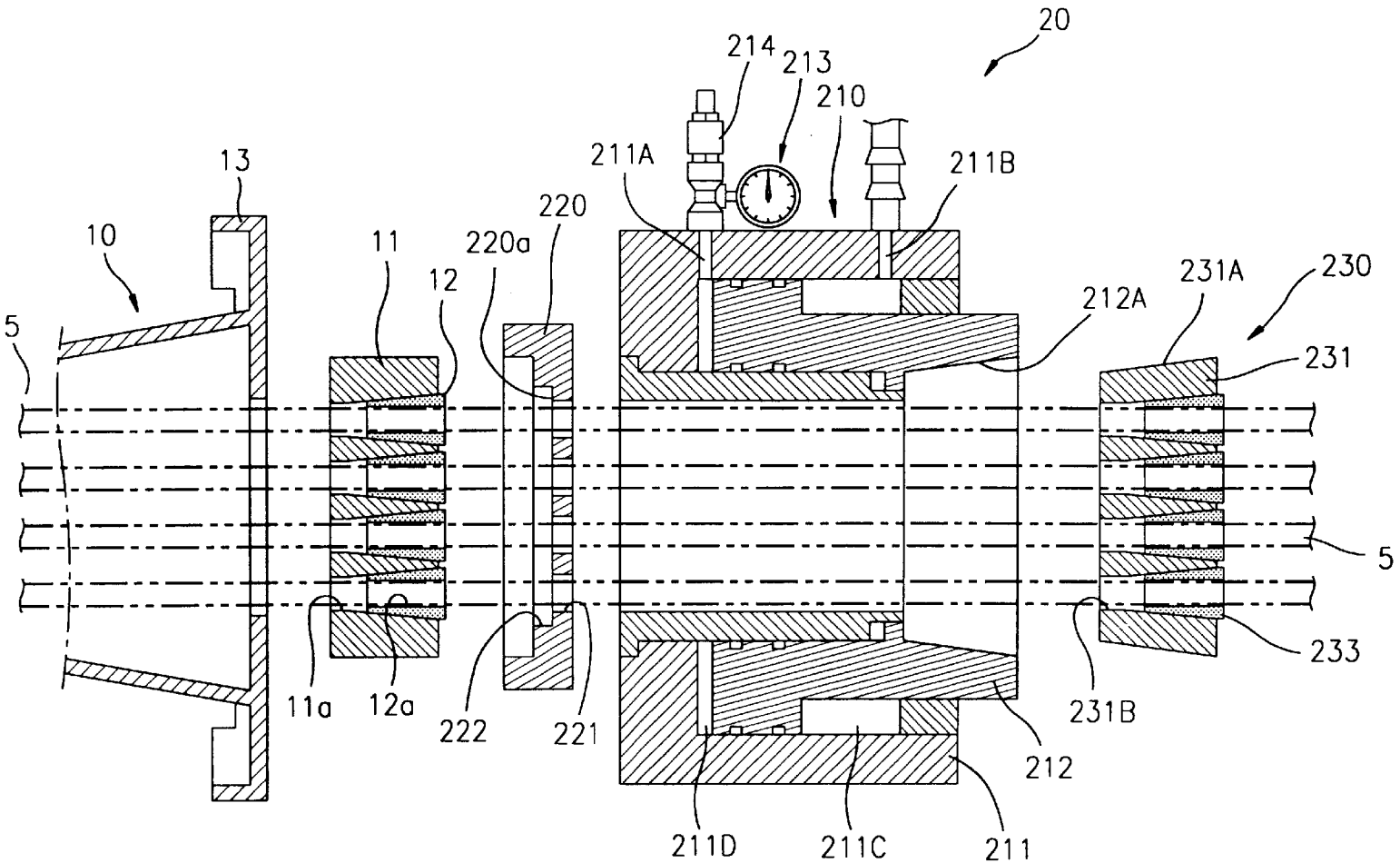
FIG. 5 is a vertical cross-sectional view illustrating a retensing apparatus which is disassembled according to the present invention.

FIG. 1 illustrates a bridge structure for explaining an installation state of a retensing apparatus according to the present invention, FIG. 2 illustrates an installation portion of the retensing apparatus of FIG. 1, FIG. 3 illustrates the construction of a retensing apparatus, FIG. 4 illustrates an engaged state of a retensing apparatus and a protection cap, FIG. 5 illustrates a retensing apparatus which is disassembled according to the present invention, and FIGS. 6A through 6D are views illustrating an operation of a retensing apparatus.

A plurality of prestressed structures, namely, a prestressed concrete beam 1, are continuously mounted on the upper portions of piers 2 which are spaced-apart across a river or the like. Both ends of each prestressed concrete beam 1 are mounted on each supporting apparatus 3 installed on the upper portions of the piers 2. A bridge upper plate 4 is mounted on the upper portions of each prestressed concrete beam 1 which is continuously formed.

In the prestressed concrete beam 1, a sheath tube 6 in which a plurality of strands 5 are inserted in the interior of the beam structure having a predetermined width, thickness and length is installed in multiple streams along the beam structure. Both ends of each strand 5 are extended into an expanding concave portion 1*b* formed at both ends of the beam structure, namely, a concave portion 1*b* having a predetermined width expanded more than the conventional concave portion and tensely supported by the fixing members 10 installed at a regular interval at the lateral walls of the concave portion 1*b*. Grease is filled into the sheath tube 6.

In the tension apparatus according to the present invention adapted to the bridge prestressed concrete beam, a tension member 20 is installed at the end portion of a support member 11 of a fixing member 10 supporting the strand 5 exposed from both ends of the prestressed concrete beam 1 which is formed in a prestressed structure for retensing a plurality of strands 5 which are backwardly extended through a plurality of collets 12 inserted into the support member 11, namely, for retensing the strand 5 in which a stress loss occurs. A checking member is provided for visually checking the decrease of the load carrying capacity of the tension member 20 due to the loss of the stress of the strand 5 tensed by the tension member.

In the fixing member 10, a conically shaped body is buried and fixed to the lateral wall of the beam structure. The front surface of the support member 11 are supported by the fixing plate 13 of the fixing member 10 exposed from the lateral walls. A plurality of collets 12 are inserted into a plurality of conically shaped support holes 11a formed at the support member 11 at a regular interval for fixing the ends of each strand 5.

The collets 12 are engaged by an engaging ring at the outer end surfaces of the bodies divided into more than two parts for thereby forming a conically shaped engaging member. A tooth-shaped protruded portion (not shown) is formed at an insertion hole 12*a* of the conically shaped collet 12 for thereby tensing the strand 5 inserted into each insertion hole 12*a*. The construction of the fixing member 10 according to the present invention is similar with the fixing member of the Korean Patent application No. 17128 recited as a conventional art in this application.

In addition, the tension member 20 installed behind the fixing member 10 includes a tension jack 210 operated by a fluid pressure applied to a cylinder body 211 for backwardly pulling each strand 5, a distance maintaining member 220 for preventing each strand 5 disposed between the front end portion of the tension jack 210 and the rear end portion of the support member 11 at the side of the fixing member 10 for preventing the strand 5 tensed in accordance with the operation of the tension jack 210 and each collet 12 escaped from the support member 11 together with the strands 5 from being moved by a predetermined distance, and a fixing member 230 installed at the rear end portion of the tension jack 220 having a predetermined slanted surface 231*a* on its outer surface for fixing the end portions of each strand 5 which is backwardly tensed by the tension jack 210.

In the tension jack 210, a cylindrical plunger 212 is movable in the interior of a hydraulic chamber of the cylinder 211 having a hollow portion 211*c* through which a tension side port 211A and a relaxation side port 211B and a plurality of strands 5 pass. An inner slanted surface 212A having the same slanted level as the slanted surface 231A of the fixing member 230 is formed at an inner end portion of the plunger 212, so that the fixing member 230 is directly inserted into the plunger 212. A checking member is provided at the tension side port 211A formed at one side of the cylinder 211 for checking a fluid pressure applied to the tension side fluid pressure chamber 211D of the cylinder 211. The checking member is formed of a pressure meter 213 indicating the inner pressure of the tension side fluid pressure chamber 211D by its scale and hand, and a check valve 214 is installed at one side of the pressure meter 213.

In addition, a tension state record table 215 is attached to the outer surface of the cylinder 211 of the tension jack for recording the tension work, namely, the pressures read from the pressure meter 213 after the tension works.

In the distance maintaining member 220, the through holes 221 through which the strands 5 extended from each collet 12 are formed at a regular interval, and a hole 222 is formed at an end portion at the entrance of each through hole 221 in order for each collet 12 escaped from the support hole 11*a* of the support member 11 to be backwardly moved, and an engaging shoulder 222*a* is formed at an inner side of each hole 222 for limiting the moving distance of the collet 12.

Figure 7:
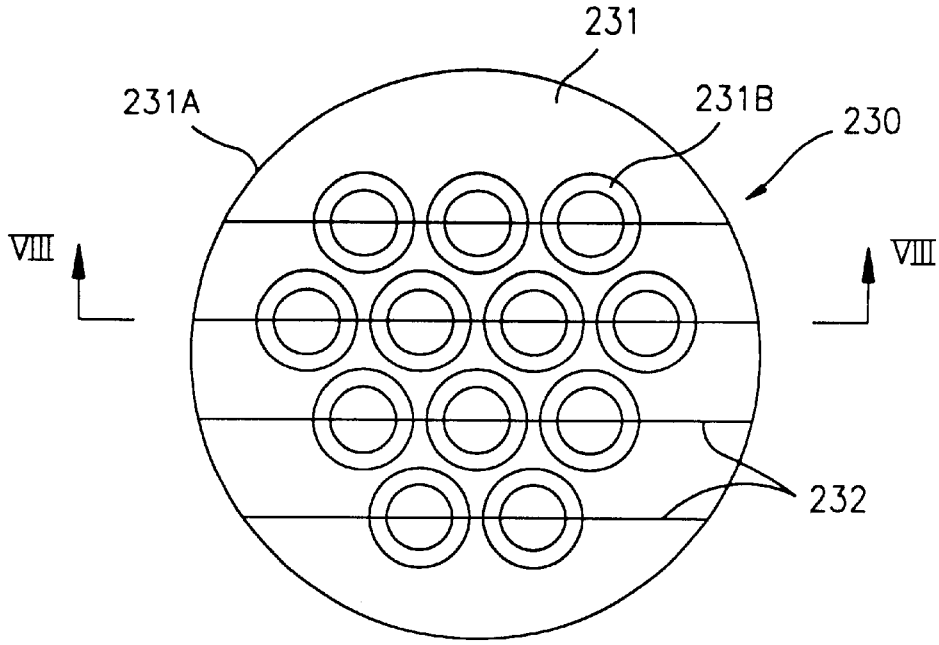
FIG. 7 is a plan view illustrating a separation structure of a collet and a collet fixing member for fixing the same according to the present invention.
Figure 8:
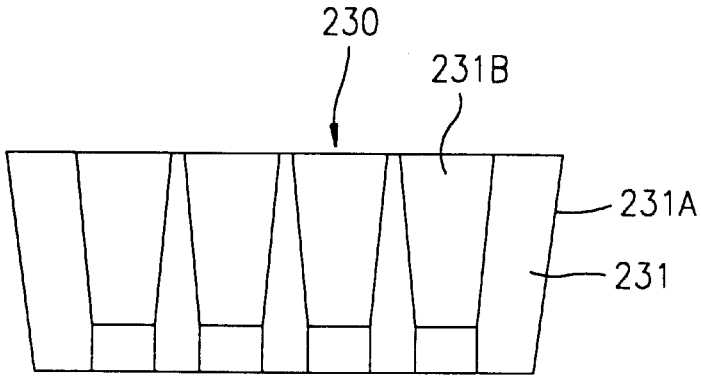
FIG. 8 is a cross-sectional view taken along line VIII—VIII of FIG. 7.
Figure 9:
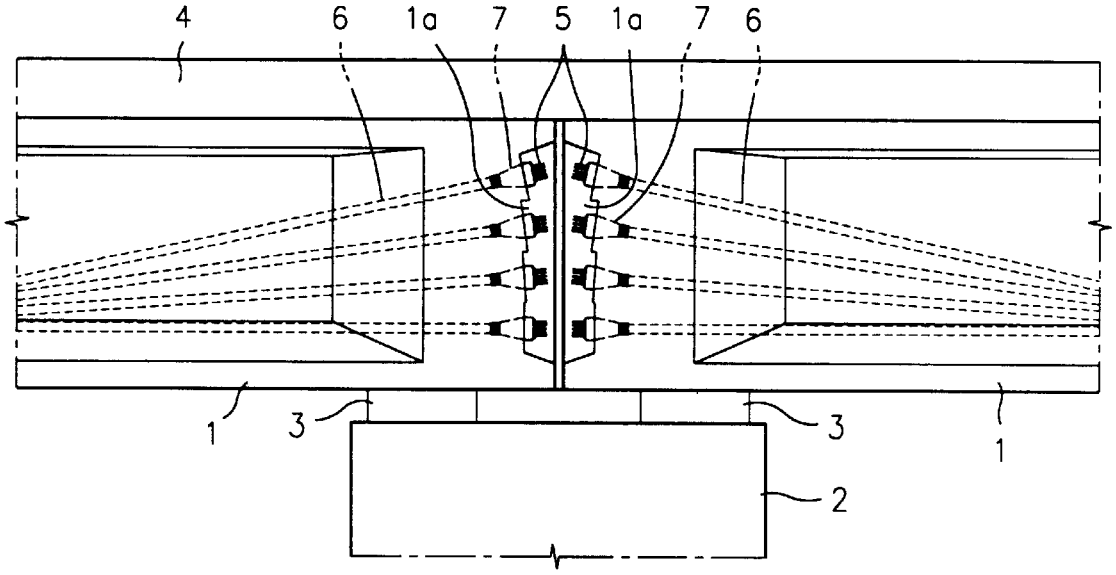
FIG. 9 BACKGROUND ART
FIG. 9 is a partial side view illustrating a bridge for explaining a state that a conventional prestress structure is adapted to a beam of a bridge.
Figure 10:
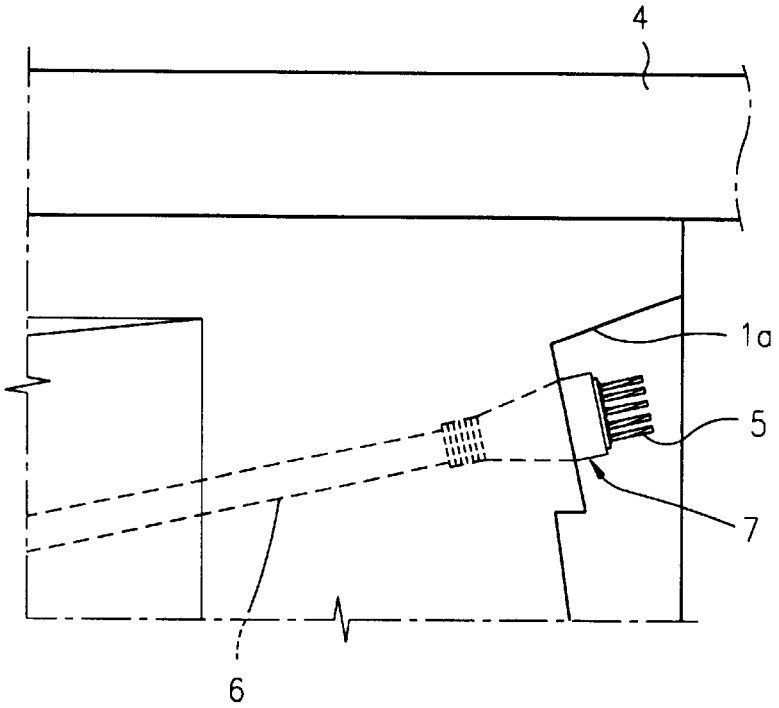
FIG. 10 BACKGROUND ART
FIG. 10 is a partially enlarged view illustrating a fixing member of FIG. 9.

The fixing member 230 includes a plurality of support holes 231B are formed at a separable body 231 having a taper shaped slanted surface 231A contacting with the inner slanted surface 212A of the plunger 212, and a plurality of collets 233 supported by the support holes 231B of the body 231 of the fixing member 230 for fixing the end portions of each strand 5. In addition, the body 231 of the fixing member 230, as shown in FIGS. 7 and 8, is separable into a plurality of parts by the separation surface 232 formed in one direction.

In the retensing apparatus according to the present invention, as shown in FIGS. 1 and 2, each tension member 20 is exposed to the concave portion 1*b* formed at the end portion of the prestressed concrete beam 1. A cylindrical cover 30 covers the outer portions of the tension member 20 for protecting the support member 11 of the fixing member 10, the distance maintaining member 220 of the tensing member, the tension jack 210 and the fixing member 230. The cover 30 is fixed to the fixing plate 13 of the mounting member 10, and a cut-away portion 31 through which the ports 213A and 213B of the fluid jack 210 and the pressure meter 213 are exposed is formed at one side of the cylindrical protection cover 30. A protection cap 32 opened during a tensing operation of the strand 5 is formed at the end portion of the protection cover 30.

Figure 6A:
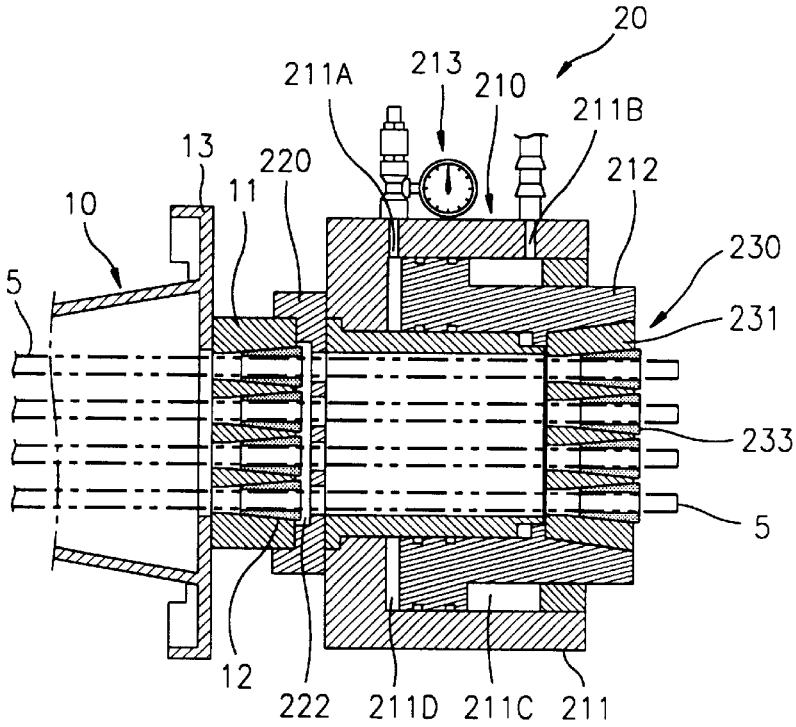

The operation of the tensing method of a strand using a retensing apparatus according to the present invention will be explained with reference to the accompanying drawings. FIG. 6A illustrates a state before the strand is tensed using the tension apparatus according to the present invention. The above-described retensing operation is performed for retensing the strand having a tension loss in a state that the prestressed concrete beam which is fabricated in a tension work and tension state is adapted for the bridge. Here, the case that the strand is retensed when a deformation or slack occurs at the prestressed concrete beam will be explained.

As shown in FIG. 6A, in the state before the tension is performed, the support member 11 contacts with the fixing plate 13 of each fixing member 10 installed at the lateral wall of the expanding concave portion 1*b*. The strand 5 is inserted into each collet 12 inserted into the support hole 11*a* of the support member 11, and the front surface of the distance maintaining member 220 having a predetermined thickness inserted into the rear surface of the support member 11.

The body of the cylinder 211 of the tension jack 210 is inserted into the end portion of the distance maintaining member 220, and the body 231 of the fixing member 230 is inserted into the inner slanted surface 212*a* formed at one end of the plunger 212 inserted into the cylinder 211. The collet 233 into which the end portion of each strand 5 is inserted into the rear side of each support hole 231B of the body 231.

In addition, the pressure applied to the tension side fluid pressure chamber 211D is indicated at the pressure meter 213 installed at the tension side port 211A of the tension jack 210.

Therefore, in this state, in order to tense the strand having a stress loss, a tension pump is connected with the tension side port 211A of the tension jack 210, and a pressure is applied to the tension side fluid pressure chamber 211D. The plunger 212 of the tension jack 210 is moved outwardly. Therefore, as shown in FIG. 6B, the fixing member 230 inserted into the inner slanted surface 212*a* of the plunger 212 is backwardly moved, namely, in the direction indicated by the arrow.

When the fixing member 230 is moved, a plurality of collets 233 inserted into the support hole 231A of the body 231 of the fixing member 230 are moved, and each strand 5 fixed by the collet 233 is pulled for thereby tensing the strands 5 at one time, so that the prestressed concrete beam is tensed for thereby obtaining its original state before the slacking occurs.

In addition, during the process that the strand 5 is tensed in accordance with an operation of the tension jack 210, the pressure applied to the tension side fluid pressure chamber 211D of the tension jack 210 is indicated by the pressure meter 213. As the pressure is increased, the values of the pressure meter 213 is gradually increased.

Figure 6B:
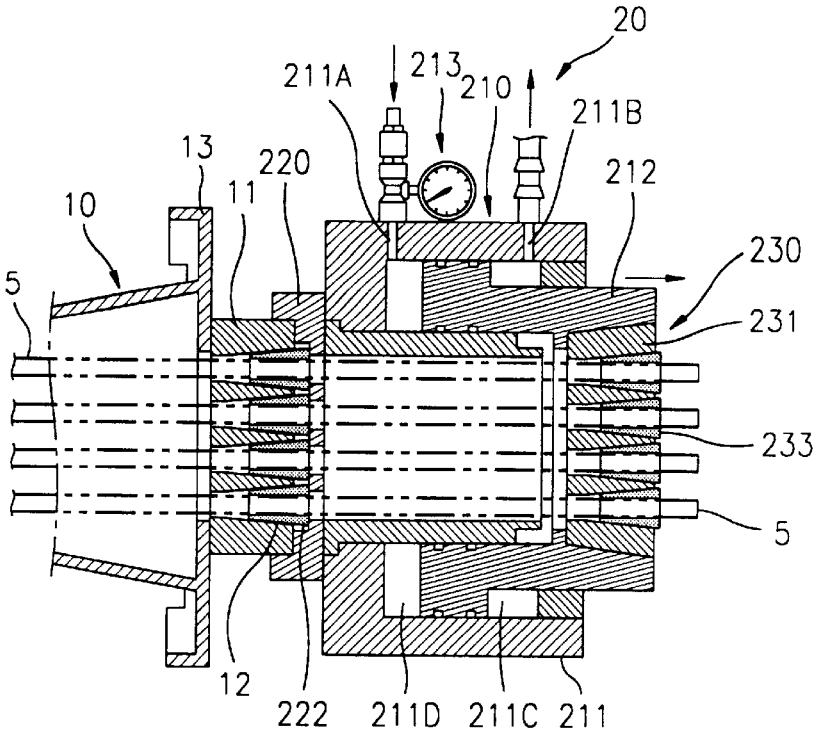
Figure 6C:
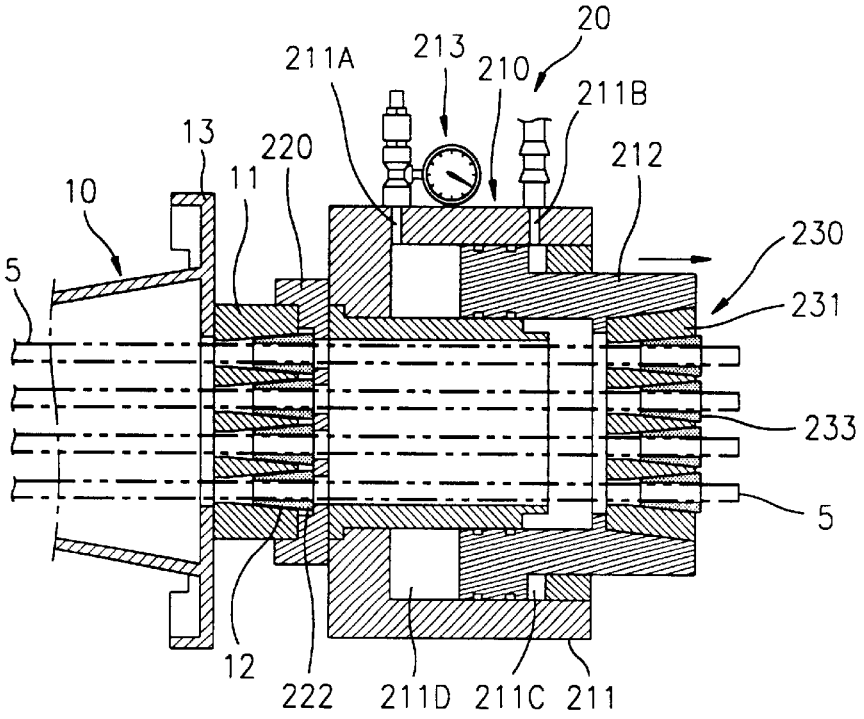

Therefore, when the tension of the strand 5 is completed as shown in FIG. 6B, the tension operator records the work date, the pressures checked by the pressure meter 213, the load carrying capacity of the cylinder 211, etc. onto the tension state record table 215.

In the tensed state of the strand 5, if a stress loss occurs again at the strand 5 after a predetermined time, the above-described tensing operation is performed. The stress loss of the strand 5 is checked by the pressure meter 213.

In more detail, in the tensed state as shown in FIG. 6B, if a stress loss occurs at the strand 5 of the prestressed concrete beam 1, the load carrying capacity of the fluid pressure chamber 211D of the tension jack 210 is decreased. The decrease of the load carrying capacity of the tension jack 210 is indicated as a decrease in the pressure checked by the pressure meter 213. Therefore, it is possible to check the stress loss of the strand by checking the value decrease of the pressure meter 213.

If the stress loss of the strand 5 is checked, the retensing operation for the strand 5 is performed using the tension jack 210 for thereby repeatedly tensing the deformed prestressed concrete beam.

Figure 6D:
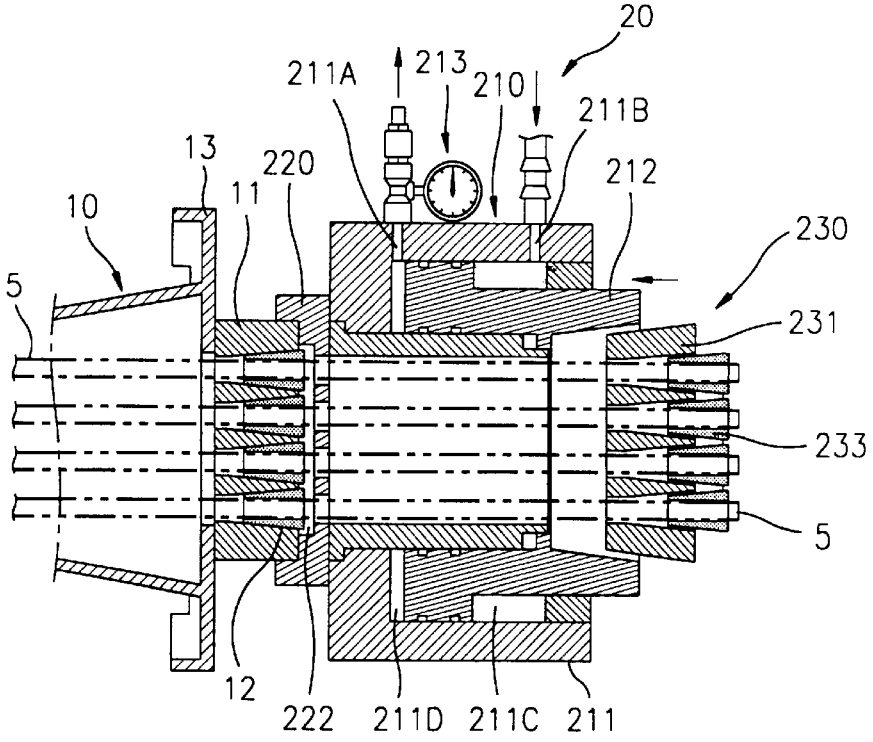

FIG. 6D is a view illustrating a process that a tension jack is recovered from the state of FIG. 6B to the state that the tension jack is tensed. In this state, the check value 214 connected with the tension side port 211A is opened, and a fluid pressure is applied to the relaxation side port 211B for thereby returning the plunger 212 to its original position. The body 231 of the fixing member 230 and the collet 233 inserted into the support hole 232B are escaped, and the fixing member 230 is returned to its original position as shown in FIG. 6A. In this state, the tension jack 210 is operated.

The above-described embodiments of the present invention are provided assuming that the prestress structure is used for a bridge girder used as an l-shaped prestressed concrete beam. Preferably, the present invention may be adapted for a prestressed structure for a continuous pier type bridge in which various beams such as a T-shape beam, a box girder, etc. or various upper structures such as a truss bridge, a slab bridge, a rahmen(rigid-frame) bridge, etc. and a FCM construction method and an ILM construction method. In addition, the present invention may be adapted for a prestress structure such as a structure girder.

In addition, in the above-described embodiment, the description that the present invention is adapted to the prestress concrete structure is provided. Preferably, the present invention may be adapted to a steel I-beam structure, etc.

As described above, in the retensing apparatus according to the present invention, the tension apparatus capable of repeatedly tensing the strand extending backwardly toward the fixing member is installed at the rear end of the fixing member for the strand tension exposed from both ends of the structure when fabricating the prestressed structure such as a prestressed concrete beam, and the checking member is provided at the tension apparatus for checking whether or not a stress loss of the strand occurs. Therefore, in the present invention, it is possible to check the loss in the prestressed force of the prestressed structure for thereby retensing the strand having the stress loss. When adapting the prestressed structure to the bridge beam, it is possible to overcome the problems encountered in the conventional art in which the bridge is not used for a predetermined time for testing whether or not the retensing operation is needed for the strand based on the load carrying capacity test, and the maintenance tension apparatus is installed at both sides of the structure. In the present invention, the stress loss of the strand is visually checked by checking the decrease of the load carrying capacity indicated by the checking member, namely, the pressure meter. The construction period is significantly decreased for correcting the deformation of the bridge beam by repeatedly tensing the strand resulting in saving in the construction cost for thereby implementing an effective maintenance. In particular, since it is possible to implement an in-time correction for the deformation or slacking of the prestressed structure, the stability of the upper structure, namely, the entire bridge is greatly enhanced, and the life span of the bridge is extended. In addition, it is possible to easily implement a retensing work of the prestressed structure having a stress loss in a limited space by minimizing the operation range of the tension jack.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. An apparatus for retensioning a prestressed structure, comprising:

retensioning means at a rear portion of a strand support fixing member having tensioned strands exposed from both ends of a prestressed structure for retensioning said tensioned strands exhibiting a stress loss;

wherein said tensioning means comprises jack means, said jack means comprising plunger means disposed in an interior chamber of said jack means, said plunger means capable of axial displacement upon application of fluid pressure into the interior chamber of said jack means, said jack means including a tension side port for application of fluid to said interior chamber and a relaxation side port for removal of fluid from said interior chamber, and said strands passing through said jack means; and means for visually determining a stress loss in said tensioned strands.

2. The apparatus of claim 1, wherein said retensioning means comprises:

tensioning means disposed at an end portion of said fixing member through which said tensioned strands pass for retensioning said strands extending toward a rear portion of said fixing member;

support means for maintaining said strands in fixed relation to said fixing member, spacer means disposed between said tensioning means and said support means; and fixing means at said rear portion of the tensioning means for fixing the ends of said retensioned strands.

3. The apparatus of claim 1, wherein said means for visually determining stress loss comprises means for determining the amount of tension in said strands.

4. The apparatus of claim 2, wherein said fixing means at said rear portion of said tensioning means comprises:

a separable body having a conical exterior surface adapted to cooperatively engage a mating interior surface in a rear portion of said plunger means; and a plurality of collets inserted into support holes in a rear portion of said fixing means for maintaining said strands in engagement with said fixing means.

5. The apparatus of claim 1, further comprising protective cover means adapted to permit access to said means for visually determining stress loss and said tension side port and said relaxation side port.

6. The apparatus of claim 3, wherein said means for visually determining stress loss comprises a pressure meter in fluid communication with said tension side port, said pressure meter further including check valve means for controlling fluid pressure applied to said tension side port.

7. The apparatus of claim 2, wherein said tensioning means further comprises a tensioning record table for recording the tension indicated by said means for visually determining stress loss.

8. The apparatus of claim 2, wherein said spacer means comprises a plurality of through holes through which said strands extend, said support means comprising a plurality of collets inserted into said support member through which said strands pass, said spacer means including means to restrict the extent of movement of said collets upon retensioning of said strands.

* * * * *